United States Patent [19]

Crosbie

[11] 4,294,445

[45] Oct. 13, 1981

[54] SIGHTING DEVICE WITH MEANS FOR REFLECTING AND SUPERIMPOSING LIGHT FLASHES ON A VIEWED OBJECT

[76] Inventor: Scott C. Crosbie, 4349 Brookside Ave., St. Louis Park, Minn. 55436

[21] Appl. No.: 121,807

[22] Filed: Feb. 15, 1980

[51] Int. Cl.[3] ..... A63J 5/02

[52] U.S. Cl. ..... 272/8 M; 46/1 E; 46/229

[58] Field of Search ..... 272/8 M; 46/1 E, 226, 46/228, 229

[56] References Cited

U.S. PATENT DOCUMENTS 1,290,078 1/1919 Cappa ..... 272/8 M

FOREIGN PATENT DOCUMENTS 581389 7/1933 Fed. Rep. of Germany ..... 272/8 M

*Primary Examiner*—George J. Marlo
*Attorney, Agent, or Firm*—Warren A. Sturm

[57] ABSTRACT

A sealed housing having a pair of axially aligned front and rear apertures defining a line of sight through the housing, with two facing mirrors disposed within the housing adjacent the front aperture, the mirrors being perpendicular to the line of sight and parallely spaced apart from one another, with one of the mirrors extending into the line of sight and being semi-transparent in the line of sight area. A pair of light emitting elements are disposed within the housing below the line of sight and on either side thereof, such that upon their operation a viewer looking into the front aperture will appear to see an endless series of light flashes directed outwardly along the line of sight and being superimposed in the field of view so as to converge on a remote object with flashes of diminishing size or intensity as seen through the rear aperture.

A further embodiment is provided wherein the facing mirrors are disposed on one side of the line of sight, and a further transparent mirror is disposed on the line of sight in a predetermined angular relationship with the image appearing on the surface of one of the transparent mirrors so as to super-impose the image appearing on the facing mirrors on the line of sight.

9 Claims, 6 Drawing Figures

SIGHTING DEVICE WITH MEANS FOR REFLECTING AND SUPERIMPOSING LIGHT FLASHES ON A VIEWED OBJECT

BACKGROUND OF THE INVENTION

This invention relates to an optical device to be used for amusement purposes, and more particularly to an optical toy gun in which it appears as though light energy travels through a scope located on the gun outwardly toward an object viewed through the scope.

It has long been known that an article can be positioned between a pair of spaced apart parallel mirrors and illuminated in such a manner that a multiplicity of reflections of the article will appear to an observer; i.e., observer will see an infinite number of images of the article instead of only one article. See, for example, Yearta, U.S. Pat. No. 2,286,247; Harris, 2,483,901. Such devices have been used primarily for the display of merchandise.

A variety of toy guns have been developed using photographic means or other optical special effects. For example, Golden, U.S. Pat. No. 3,218,745 discloses a photographic toy gun having a transparency viewer and a mechanism for moving an endless film strip across the viewer to provide a target image for shooting by the user. Ryan, U.S. Pat. No. 3,397,484 discloses a toy gun having a telescopic sight with a transparent mirror set in the line of sight, and a mechanism for reflecting images from a V-shaped mirror onto the transparent mirror to simulate the firing of ray guns or shell firing weapons. However, none of the presently available toy guns have utilized a pair of parallely spaced apart mirrors to create the appearance of an endless succession of light flashes converging along the line of sight and appearing to be superimposed on a remote object seen through the device.

SUMMARY OF THE INVENTION

In accordance with this invention there is provided an optical device comprising a housing having a pair of axially aligned front and rear apertures defining a line of sight through the housing, at least two mirrors disposed within the housing, both mirrors being substantially perpendicular to the line of sight and parallely spaced apart from one another, with one of the mirrors extending into the line of sight and being transparent in the lne of sight area, and means for introducing light from a point located between the mirrors and out of the line of sight. A person looking through the rear aperture will see the appearance of an endless series of light flashes directed outwardly along the line of sight and appearing to be superimposed on objects seen through the housing. Preferably, the housing is in the shape of a gun scope, mounted above a toy gun barrel.

It is a primary object of this invention to provide a toy gun having a scope through which flashes of light will appear to converge in an endless series along the line of sight toward a remote target object.

It is another object of this invention to provide an optical toy gun capable of presenting to a viewer the appearance of light flashes being superimposed on a remote target object without the need for any moving mechanical parts.

It is a further object of this invention to provide an optical toy gun which can be inexpensively manufactured and operated, and which will be capable of a troublefree long life.

DESCRIPTION OF THE PREFERRED EMBODIMENT

Figure 1:
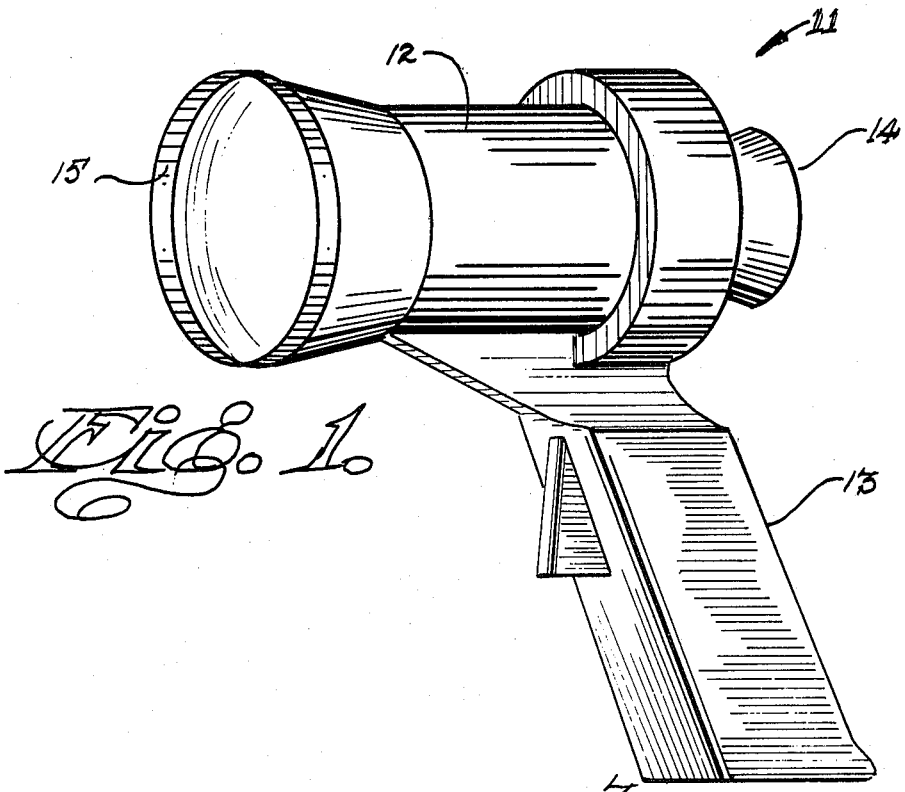
FIG. 1 is a perspective view of the optical toy gun of this invention.

Referring to FIG. 1 of the drawings, optical device 11 is in the form of a simulated laser gun having a tubular housing 12 and handle 13, the tubular housing 12 having a viewing aperture 14 at one end and an axially aligned front aperture 15 at the other end, such that a line of sight through housing 12 is defined by the axis of the two apertures. Although the optical device is shown in a tubular construction, the housing as well as the viewing and front apertures can be of any desired shape; for example, rectangular. Also, although a hand held device is shown, it is clear that the invention can be used in a console or mounted device.

Figure 2:
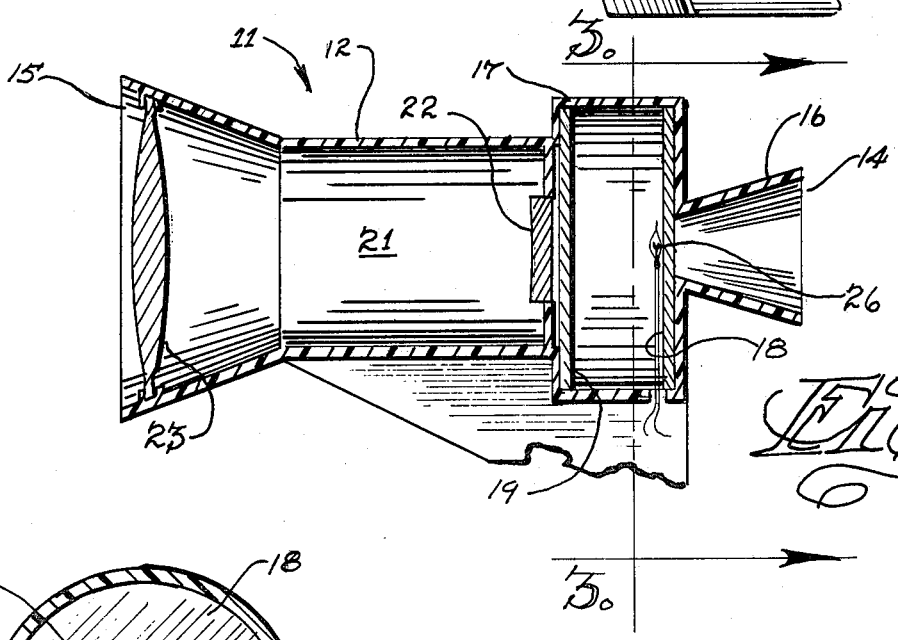
FIG. 2 is a side elevational view of the toy gun shown in FIG. 1.

Referring to FIG. 2, tubular housing 12 comprises ocular portion 16 having viewing aperture 14, mirror chamber 17 having mirrors 18, 19, and elongated portion 21, having lenses 22, 23 and front aperture 15. Mirror 19 is a transparent mirror, i.e., a mirror capable of reflecting light from one direction, as do ordinary "opaque" mirrors, passing light from the other direction. Mirror 18 is an ordinary opaque mirror, except that it is transparent, at the axis of the line of sight.

Mirrors 18, 19 are parallel to each other and substantially perpendicular to the line of sight through the housing. The mirrors are spaced apart at any desired distance; the closer together the mirrors the fewer the light flashes created, as will be described below.

Figure 3:
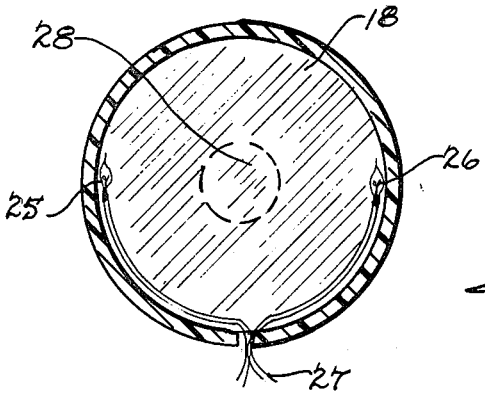
FIG. 3 is a view taken along line 3—3 of FIG. 2.

A pair of light emitting elements 25, 26, as shown in FIG. 3, are disposed between mirrors 18, 19, the elements being located on the same side of mirror 18 and directly across from one another at the level of the line of sight. The elements are energized through wiring 27 from a battery located in handle 12 through an off-on switch (not shown). Center portion 28 of mirror 18, shown in dotted lines, has been made transparent by scraping away of a portion of its "silvered" backing.

Figure 4:
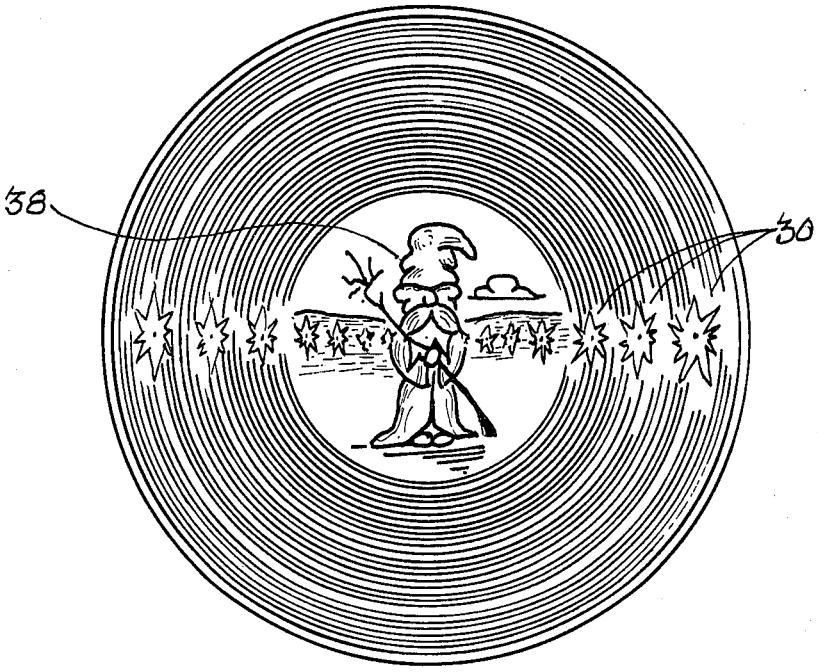
FIG. 4 is an enlarged view of the image seen through the front or viewing aperture of the toy gun shown in FIG. 1.

In operation of optical device 11, the user looks through viewing aperture 14 and moves the device until a desired target object is brought into the line of sight. The target object can be a remote actual object, or an artificial target such as the image 38 shown being viewed in FIG. 4. The next stop is pushing the on-off switch to activate light emitting elements 25, 26. The light from each element will be reflected back and forth between mirrors 18, 19 and will appear to converge and be superimposed upon the image positioned at the center of the line of sight. The overall impression sensed by the viewer will be that of an endless series of light flashes 30 directed outwardly from the gun toward a remote target object. The result is an ultimate illusion of light traveling through space, as with a laser gun.

Figure 5:
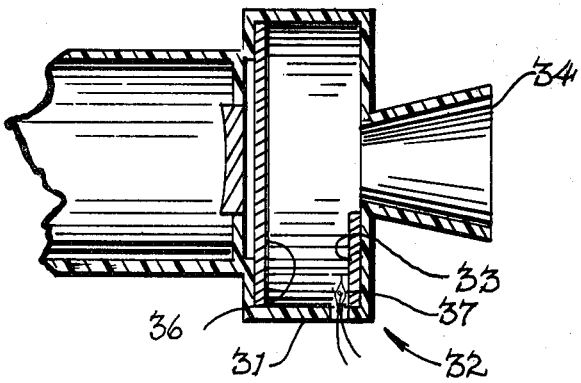
FIG. 5 is a fragmentary side elevational view similar to that of FIG. 2 showing an alternate mirror arrangement.

FIG. 5 shows an alternate embodiment of the invention wherein a housing 31 of an optical device 32 has an opaque semi-circular mirror 33 disposed adjacent a viewing aperture 34. A second transparent mirror 36 is disposed parallel to and in front of mirror 33. A light source 37, is disposed in the housing between mirrors 33 and 36.

Figure 6:
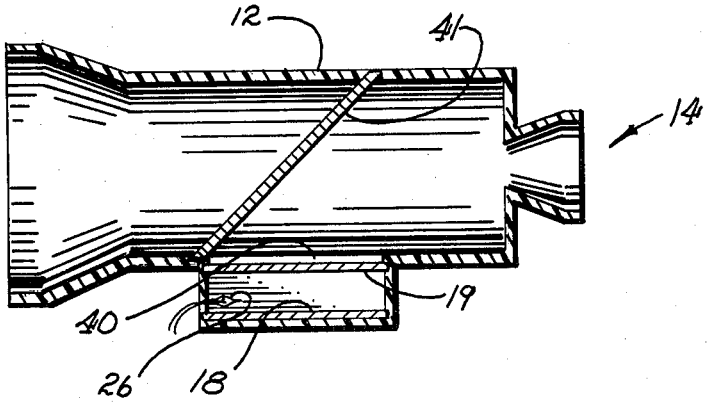
FIG. 6 is a fragmentary side elevation view of a further embodiment of my invention

FIG. 6 shows a further embodiment of my invention using parallel mirrors 18 and 19 and a light emitting element 26 (the same as in the embodiment of FIG. 2). Mirrors 18 and 19 are mounted outside of housing 12. Housing 12 has an aperture 40 adjacent mirror 19 and a transparent mirror 41 disposed at an appropriate angle to reflect the image formed between mirrors 18 and 19 so as to be parallel to the axis of housing 12.

In addition to the above embodiments, various means can be used for introducing light into the space between the opposed mirrors of the mirror chamber, depending on the number of "light rays" desired to appear in the viewing screen. Also, a second lighting means can be used to direct light along the line of sight back through the viewing aperture, for further optical special effects, such as the "explosion" of a target. It is essential, however, that a pair of parallel mirrors be spaced apart substantially perpendicular to the line of sight, as described above, to create the unique illusion of this invention.

The optical device of this invention can be used as a simulated scope on a toy gun, for sighting of targeted objects, or as the gun itself.

It is claimed:

1. An optical device for amusement purposes comprising;

a housing having a pair of axially aligned front and rear apertures defining a line of sight through said housing; at least two spaced-apart mirrors disposed in parallel relationship to reflect images towards each other in an intermediate chamber in said housing, one of said mirrors being transparent over its reflective surface, said last named mirror being in communication with the interior of said housing;

a source of light disposed between said mirrors; and a further transparent mirror disposed in said housing intermediate said front and rear apertures and adjacent said chamber so as to reflect an image of the light appearing on said first mentioned transparent mirror in a direction parallel to the line of sight of said front and rear apertures in said housing whereby the image of the light appearing on said first mentioned transparent mirror is superimposed on the line of sight through said housing and said further transparent mirror.

2. An optical device for amusement purposes comprising;

a housing having a pair of axially aligned front and rear apertures defining a line of sight through said housing;

a pair of mirrors disposed within the housing and being substantially perpendicular to said line of sight, said mirrors having reflective surfaces disposed to reflect images toward each other and being spaced apart in parallel relationship, one of said mirrors being substantially non-reflective over a center portion and the other of said mirrors being transparent; and at least one source of light disposed intermediate said mirrors whereby an endless series of light flashes directed outwardly along the line of sight are superimposed on objects viewed along the line of sight of said housing.

3. The optical device of claim 2 wherein the pair of mirrors are disposed within the housing in facing relationship, the mirror adjacent the front aperture being transparent and the second mirror being opaque, except in the line of sight area where it is transparent.

4. The optical device of claim 1 or 2 wherein the source of light comprises a pair of light emitting elements disposed below the line of sight on either side thereof.

5. The optical device of claim 2 wherein the housing is hand holdable, with a handle grip and a trigger mechanism for turning the light means on and off.

6. The optical device of claim 5 wherein the housing has a tubular shape and an elongated tubular extension connected to the rear aperture to shield light from entering the back aperture, and to simulate the barrel of a gun.

7. The optical device of claim 2 additionally comprising a second source of light disposed intermediate the mirror.

8. The apparatus of claim 2 in which the mirrors are of the same size.

9. In an amusement device, the combination, comprising;

viewing means for observing an object, said viewing means including an aperture for directing the viewing attention of an observer to said object and means for super-imposing a pattern of indicia on the field of view through said aperture, said means including opposed reflective surfaces and a light source, said pattern of indicia being comprised of individual indicia of progressively increasing size with increasing distance from the view of said object observed through said aperture.

* * * * *